United States Patent [19]

Nolan et al.

[11] 4,136,463

[45] Jan. 30, 1979

[54] RADIANT HEAT PAINT SPRAY CHAMBER

[75] Inventors: Damon P. Nolan; Damon P. Nolan, II; Kevin T. Nolan, all of 888 ElCielito, Denton, Tex. 76201

[73] Assignees: Damon P. Nolan; Damon P. Nolan, II; Kevin T. Nolan, all of Denton, Tex.

[21] Appl. No.: 742,092

[22] Filed: Dec. 6, 1976

[51] Int. Cl.[2] ..... F26B 3/32

[52] U.S. Cl. ..... 34/39; 34/243 C; 118/58; 118/64; 118/DIG. 7

[58] Field of Search ..... 34/4, 39, 40, 243 C, 34/74, 79; 126/271; 118/DIG. 7, 58, 64, 326

[56] References Cited

U.S. PATENT DOCUMENTS

| | | | |
|---|---|---|---|
| 1,120,625 | 12/1914 | Perkins | 34/74 |
| 1,160,980 | 11/1915 | Geer | 118/DIG. 7 |
| 1,183,889 | 5/1916 | Lippert | 34/74 |
| 1,211,325 | 1/1917 | Lilly | 118/DIG. 7 |
| 1,327,314 | 1/1920 | Cunliffe | 118/58 |
| 1,646,010 | 10/1927 | Clover | 34/4 |
| 1,742,861 | 1/1930 | Johnson | 126/271 |
| 2,229,725 | 1/1941 | Cheasley | 118/DIG. 7 |
| 2,445,074 | 7/1948 | McCue | 118/DIG. 7 |
| 2,841,684 | 7/1958 | Miskella | 34/4 |
| 3,016,442 | 1/1962 | Brach | 34/4 |
| 3,793,741 | 2/1974 | Smith, Jr. | 34/54 |
| 4,000,850 | 1/1977 | Diggs | 126/271 |

*Primary Examiner*—John J. Camby
*Assistant Examiner*—Larry I. Schwartz
*Attorney, Agent, or Firm*—Richards, Harris & Medlock

[57] ABSTRACT

The specification discloses a paint spray booth adapted to provide radiant heat to an object in preparing the object for painting. The booth chamber includes a structure for housing a vehicle or other objects to be painted with tubing fixed in surface contact with the sides of the structure. A system for circulating a heated fluid, such as water, through the tubes is provided to thereby heat the walls of the structure. The heated fluid is circulated through the tubing being heated by a boiler unit and driven by a standard pump acting in conjunction with a thermostat and the boiler. The tubing in the walls is insulated to direct radiant heat into the structure whereby the object to be painted is heated and kept at an optimum drying temperature.

12 Claims, 5 Drawing Figures

RADIANT HEAT PAINT SPRAY CHAMBER

BACKGROUND OF THE INVENTION

1. Field of the Invention

The present invention relates to a paint spraying chamber and more particularly to a paint chamber for heating objects in preparation for painting and for drying with radiant heat.

2. Prior Art

Paint spraying operations are often conducted in enclosed spray booths so that the working environment may be controlled. Moreover, enclosed paint spraying structures are required to prevent outer atmospheric pollution. While the paint spraying booths provide a finite area in which the environment may be controlled, the painting process necessarily produces volatile paint-/solvent mist and fumes which must be removed from the spraying area. This is required for personnel safety as well as to assure the quality of the product finish which might otherwise be damaged by paint overspray and fumes left in the spraying environment. The need to remove paint/solvent, overspray and fumes from a controlled paint spraying environment is accompanied by the need to maintain or bring the temperature of the object being painted within an acceptable range for painting purposes. It has been found that most paint spraying operations may optimally be performed if the surface of the object being painted is in the range of 68° to 90° F. Thus, where painting operations are conducted during the cool weather months, the working environment or at least the object being painted must be maintained within this optimum temperature.

The requirement that the working atmosphere be free from volatile paint/solvent, overspray and fumes is normally accomplished by drawing air through the spray booth and filtering it of these contaminates prior to exhausting it to the outer atmosphere. The need for maintaining the object being sprayed at an acceptable temperature to properly accept the paint being applied has heretofore been accomplished by heating the air passing through the paint spraying chamber. Because the air cannot be sufficiently filtered of the contaminates therein for it to be recirculated into the paint spraying chamber, the exhausting of the heated air into the outer atmosphere represents an enormous loss of energy and represents the inefficiency of the conventional prior art spray booth. As a result of this inefficient process, prior art units used for automobile and truck painting require heating units producing up to, and in some cases exceeding, several million BTUs per hour to sufficiently heat the air to maintain the automobile at an acceptable temperature. Therefore, a need has arisen for a paint spray chamber which efficiently heats the object to be painted in preparing it for the painting and drying process.

SUMMARY OF THE INVENTION

The present invention discloses a system which overcomes many of the limitations heretofore found in the prior art paint spraying booths. The present invention provides a system for heating vehicles or other objects in preparing them for painting. The system uses radiant heat which is uneffected by the circulation of air through the paint spraying booth.

In one embodiment of the invention a paint spray booth is adapted to provide radiant heat to an object in preparing the object for painting. The booth chamber includes a structure for housing a vehicle or other objects to be painted with tubing fixed in surface contact with at least one side of the structure. A system for circulating a heated fluid, such as water, through the tubes is provided to thereby heat the walls of the structure. In one embodiment, the heated fluid is circulated through the tubing being heated by a boiler unit and driven by a standard pump acting in conjunction with a thermostat. The tubing in the walls is insulated to direct radiant heat into the structure whereby the object to be painted is heated.

By providing a system for generating radiant heat from the heated tubing and walls surrounding the vehicle to be painted, the circulation of air through the painting chamber which is necessary to remove fumes and overspray mist from the chamber is uneffected. By relying upon radiant heat which is projected from the walls of the chamber and absorbed by the surface of the vehicle being painted, the heating of the vehicle is not dependent upon the temperature of the air circulating through the chamber and therefore heat may be applied in a much more efficient manner. Moreover, radiant heat projected evenly from the various wall areas of the spraying chamber may more evenly be controlled and applied to the vehicle and is uneffected by the tendency of the heated air to circulate upwardly and to produce a heat gradiant from the floor to the ceiling in the spray booth chamber.

In accordance with another embodiment of the invention, the insulation of the tubing and walls is by applying a substantial layer of polyurethane over the entire outer wall of the structure and over the tubing positioned there against. In one embodiment of the invention, the polyurethane also serves to bond the tubing immediately adjacent to the outer wall of the chamber structure thereby directing the radiant heat from the heated fluid circulating in the tubing into the wall of the structure and into the spray booth chamber.

In accordance with still a more specific embodiment of the invention, the tubing is attached along the surface of the structure in a serpentine configuration to increase the surface contact between the tubing and the wall of the structure. The tubing includes a feeder line extending from the pump and boiler units and an exhaust line for carrying the heated fluid back to the storage tank. A plurality of section lines communicated between the feeder line and the exhaust line and extend over segregated sections along longitudinal stations of the structure. A valve is positioned within each section line for restricting the flow of fluid through each section line. This permits the control of the temperature of each section along the outer structure and permits the generation of uniform heat throughout the length and width of the chamber.

DESCRIPTION OF THE DRAWINGS

For a more complete understanding of the present invention, and for further details and advantages thereof, reference is now made to the following description taken in conjunction with the accompanying drawings in which.

DESCRIPTION OF THE PREFERRED EMBODIMENTS

Figure 1:
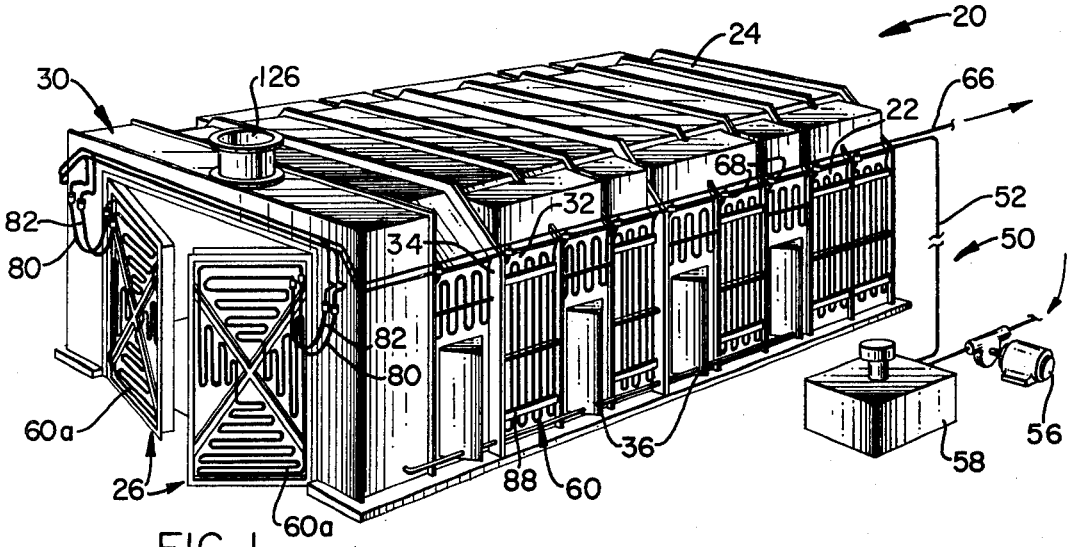
FIG. 1 is a perspective view of the paint spraying booth with the tubing in place around the outer walls of the structure prior to the application of insulation onto the booth.
Figure 2:
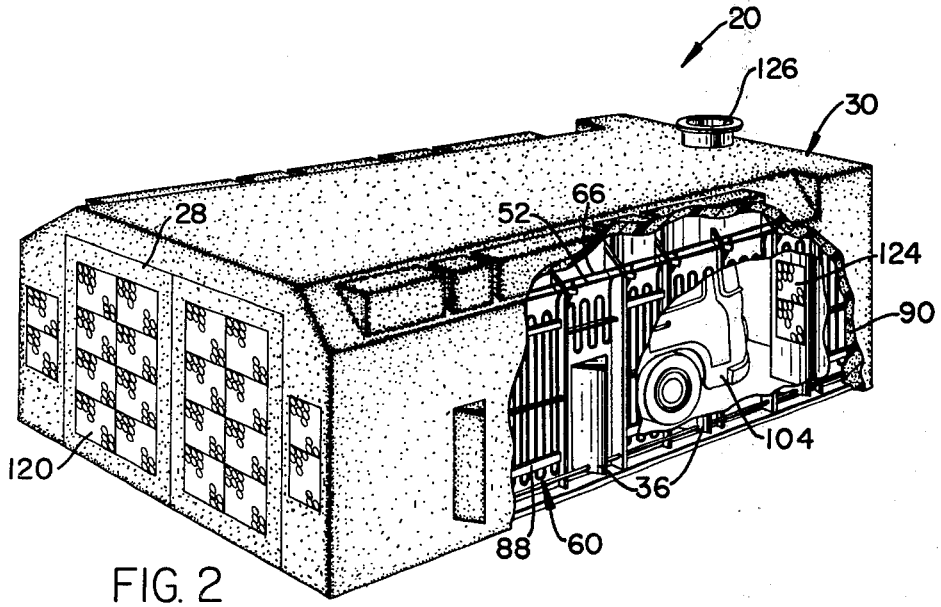
FIG. 2 is a perspective view of the paint spraying booth viewing the booth from a direction opposite that from which the booth is viewed in FIG. 1 and particially broken away to show the location of a vehicle in the booth ready for painting, a section exposing the tubing and a section showing the insulation applied over the outer surface and tubing.

FIGS. 1 and 2 illustrate in perspective view a paint spraying booth or chamber 20 embodying the present invention. Chamber 20 includes a structure similar to other conventional paint spraying booths having side walls 22, a top 24, exit doors 26, and entrance doors 28 (FIG. 2). Paint chamber 20 is also adapted with an air circulation and filtration system 30 positioned at the forward end of the spray chamber. The spray chamber may generally be constructed from 18 gauge sheet metal panels 32 supported by beams 34. Side walls 22 are adapted with light fixture housings 36 in which flourescent lighting is positioned to provide lighting within the paint spraying chamber.

Figure 3:
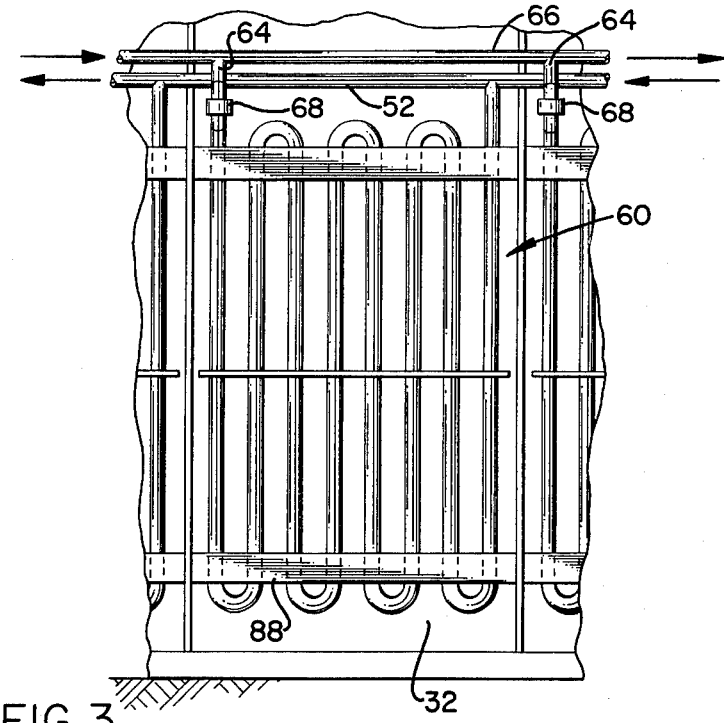
FIG. 3 is a partial side elevation of the paint spraying booth of the present invention as seen prior to the application of insulation over the tubing and the outer wall of the unit.

FIGS. 1 and 2 illustrate the modification of the paint spraying chamber in accordance with the present invention. In accordance with the invention, a tubing system 50 is applied to the side walls 22 and the exit doors 26. This tubing system includes a feeder line 52 attached around the entire perimeter of the paint spraying chamber and carrying a fluid 54 (not shown) from pump 56 through boiler 58 where the fluid is heated. As can best be seen in FIG. 3 tubing sections 60 are connected to feeder line 52 and are formed in a serpentine configuration in surface contact with panel 32 of side wall 22. The straight portions of tubing sections 60 are generally parallel one to the other interconnected by curved portions therebetween. The end of tubing section 60 opposite its connection to feeder line 52 is coupled by appropriate fitting 64 to an exhaust line 66 which carries the fluid channeled into coil 60 from feeder line 52 to a storage unit for later recycling. A restrictor valve 68 is fitted in tubing 60 adjacent its connection to exhaust line 66 by appropriate fittings or by brazing and permits the restriction of the flow of fluid through tubing 60 as desired. While FIGS. 1 and 2 show heating tubes on only sides 22 and exit doors 26, it will be apparent to one skilled in the art that where necessary, similar tubing may be employed on the top, bottom and the entry side of the paint spraying chamber.

Figure 4:
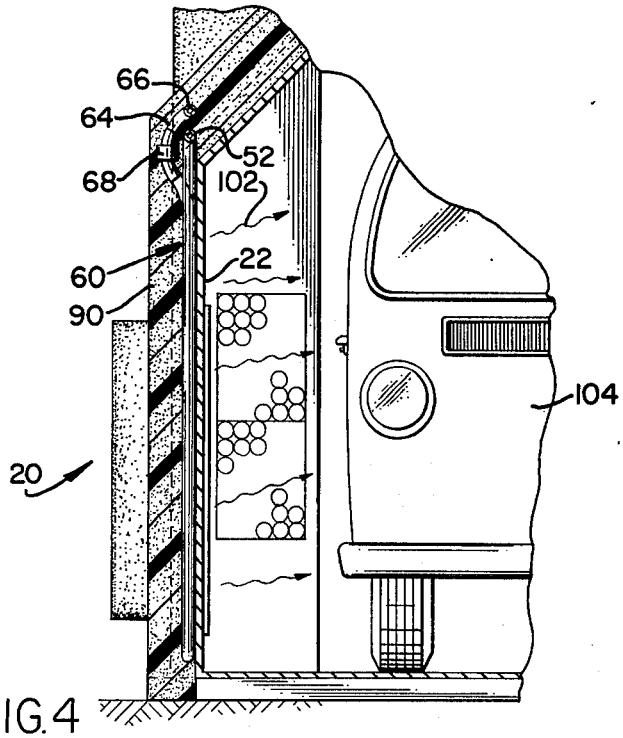
FIG. 4 is a partial vertical section view of the paint spraying booth of the present invention.

In one embodiment of the invention, feeder line 52 and exhaust line 66 are 2 inch reduced to 1 inch copper tubing and tubing 60 is three-quarter inch copper tubing. This diameter variation increases the flow pressure downstream from the pump. Restrictor valve 68 is joined in tubing 60 by brazing into the line. Referring to FIG. 1, it is seen that feeder line 52 carries fluid from pump 56 and boiler 58 to a plurality of tubing sections 60 coiled along the surface of side walls 22 and in doors 26, thereby increasing the surface contact between tubing section 60 and panels 32 of side walls 22 and exit doors 26. After passing through tubing sections 60 fluid 54 is exhausted through exhaust line 66 to a storage chamber for later recycling. As is shown in FIG. 1, fluid is carried into similar tubing sections 60*a* positioned in exit doors 26 by flexible tubing 80 and thereafter carried to exhaust line 66 by a similar flexible tubing 82. These flexible connectors permit the opening and closing of exit doors 26 which is necessary for the removal of the vehicle or other object from spray chamber 20 after painting is completed. As can be seen in FIG. 4, tubing sections 60 are in surface contact with side walls 22 and are similarly in surface contact with the sheet metal forming exit doors 26.

The completed structure of the present invention is illustrated in the perspective, partially broken away view, of FIG. 2. Tubing sections 60 are temporarily braced against side walls 22 and exit doors 26 by the use of boards 88 which force the tubing into surface contact with the sheet metal sections making up the side walls and the exit doors. Thereafter, a layer of insulating foam 90, such as polyurethane foam, is applied by spraying or other suitable means of application over the entire outer surface of paint spray chamber 20 as well as over the circulation tubing system 50. It has been found that the polyurethane foam is sufficient to permanently attach the tubing system to the side walls and exit doors of the chamber and boards 88 are therefore removed prior to being coated with the insulating foam 90. In one embodiment of the invention, where the tubing sections 60 are ¾ inch copper tubing, the insulation is applied to a 3 inch thickness over the entire outer surfaces of paint spray chamber 20. The insulation is thereafter painted for protection. As mentioned earlier, and as can be seen in FIG. 4, the polyurethane foam 90 bonds the tubing system to side walls 22 such that the tubing is in surface contact with the wall, thereby increasing the heat transfer as will hereinafter be discussed in greater detail.

Figure 5:
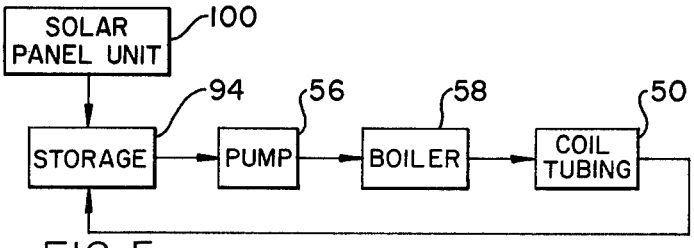
FIG. 5 is a schematic diagram illustrating the stations through which the heated fluid passes during the operation of the invention.

FIG. 5 illustrates in schematic form the flow course followed by the heated fluid of the present invention. From storage unit 94, the fluid is drawn through pump 56 and into and through boiler 58. Thereafter the fluid is pumped into fluid circulation tubing system 50 thereafter being returned to storage chamber 94. The pump 56 may be a conventional centrifugal pump such as that produced by Bell and Gassath. A conventional broiler having a capacity of 200,000 BTUs has been found more than adequate for an embodiment of the present invention wherein the paint spraying chamber is 34 feet in length, 11 feet tall, and 9 feet wide. Additional heat may be introduced into the system by the use of a solar panel unit 100 acting in conjunction with the storage unit to use solar energy to initially heat the water pumped into the boiler.

In operation of the unit, a fluid, such as water, is pumped from the storage chamber 94 into boiler 58 where it is heated to an optimum temperature between 150°–160° F. In one embodiment of the invention, 200 gallons of water is employed in the system. A thermostat within the spray chamber causes water to be pumped into the fluid tube system 50 where it is brought into feeder line 52 and into the various coil tube sections 60 whenever the temperature within the chamber drops below a predetermined level. The heated water transfers heat to the tubing and because of the surface contact between the tubing and the walls of the spray chamber, to the walls of the chamber. The insulating foam covering the entire spray chamber as well as the tubes extending along the side and exit doors of the chamber insulates the spray container while directing radiant heat from the tubing and the walls of the spray container directly to the surface of the vehicle or other object within the spray chamber to prepare it for painting. The radiant heat, symbolized by arrows 102 in FIG. 4, is directed from tubing sections 60 and wall 22 and is partially absorbed in the surface of the vehicle 104 within the spray chamber. That radiant heat reflected from the surface of the vehicle is again redirected toward the vehicle upon reflection from the wall of the spray chamber.

The radiant heat being projected from the various sections around the spray chamber is regulated by the use of restrictor valve 68 (FIG. 5). By restricting the flow of heated fluid through tube sections 60, the radiant energy emitted by each section may be regulated to uniformly heat the vehicle within the paint chamber. Thus, where more radiant heat is projected from one portion of the spray chamber as is monitored by temperature gauges positioned at various stations around the chamber, restrictor valve 68 is closed to limit the amount of heated fluid passing through a particular tube section thereby reducing the heat conducted through the tubing to the walls of the spray chamber. By opening and closing the various restrictor valves 68 around the perimeter of the spray chamber, the amount of radiant energy emmitted from the various locations around the chamber may be regulated to evenly heat the vehicle within the chamber. The total heat emitted by the system is controlled by controlling the temperature of the water pumped through the system.

Thus, by radiant heat the surface of the vehicle positioned within the spray chamber is brought to an optimum temperature of 68° to 90° F. At this temperature, the vehicle's surface readily accepts paint applied thereto.

As is seen in FIG. 2, the conventional air circulation and filtration system is employed in the present invention to filter the air of contaminants prior to discharging it into the outer atmosphere. However, there is no longer the necessity of heating this air for purposes of heating the vehicle in preparing it for painting, set up or drying. As can be seen in FIG. 2, the air circulation and filtration system includes inlet filters 120 in entrance doors 28. Air is drawn through filters 120 in order to purify the air prior to bringing it into paint chamber and thereafter drawn through plenum filters 124 by exhaust fans (not shown) within unit 30 and exhausted through exhaust port 126 into the outer atmosphere. Thus, it becomes readily apparent that where the air drawn through the paint chamber by the air circulation and filtration system serves as the means for heating the vehicle to a temperature necessary for painting, the heat energy required to heat the air is lost as the air is exhausted to the outer atmosphere. As has been mentioned earlier, because of the inability to sufficiently filter the air of volatile fumes and solvent mist the air cannot be recirculated into the paint spray chamber. Thus, all of the heat energy used in heating the air is lost as it is exhausted to the outer atmosphere.

This may be particularly appreciated when it is realized that it is generally necessary to circulate air at 14,000 cubic feet per minute through the chamber in order to remove paint and solvent fumes and paint overspray which would otherwise contaminate the painting environment.

In contrast to this prior art system, the present invention overcomes the inefficiency inherent therein by using radiant heat generated by the flow of a heated fluid which is recycled through tubes and surface contact with the walls of the paint spray chamber. The radiant heat projected from the walls to the surface of the vehicle being prepared for painting is uneffected by the flow of air through the chamber resulting in a more efficient heating of the vehicle in preparation for painting. Studies have shown that the cost of operating a system in accordance with the present invention is on the order of one-tenth that required for the conventional systems wherein the air is heated in order to maintain surface temperatures necessary for painting. For example, the conventional systems require as much as a one million BTUs per hour heating unit in order to heat the air which is circulated through the paint spray chamber. In the present invention, only a 200,000 BTUs per hour heating unit is required to heat the water or other fluid necessary to generate the radiant heat employed by the present invention. Of course, even a smaller heat unit would be required where solar energy is used in conjunction with the boiler for heating purposes. Additionally, where radiant heat is used to maintain proper surface temperatures for painting, the paint cures without dulling as is normally the case when heated air is used within the paint chamber during the application and drying of the paint. Moreover, the time required to bring the surface of the vehicle to be painted to the required 68° F. is substantially less in the system of the present invention than in conventional paint spray chamber systems.

Therefore, the present invention discloses a system for employing radiant heat for heating vehicles or other objects in preparing them for painting. Such a system negates the need for employing circulating air passing through the paint chamber as the heating medium for maintaining the object to be painted at a sufficient temperature. Because of the use of radiant heat produced by circulating heated fluid through coil tubes in surface contact with the walls of the paint spray chamber. The waste of heat energy of the conventional systems wherein the heated air is exhausted to the outer atmosphere is eliminated. Indeed, the present system has been found to reduce the cost of supplying heat by as much as 90%. Moreover, the use of radiant heat lessens the tendency of paint dulling which usually occurs where heated air is used to maintain the surface temperature of the object being painted.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. A paint chamber for applying radiant heat to an object to prepare the object for painting comprising:

a structure for housing the object to be painted;

tubing fixed in surface contact with the outside of at least one wall of said structure;

means for circulating a heated fluid through said tubing to thereby heat the wall of said structure in which said tubing is in contact; and means for insulating the outside of the wall of said structure in which said tubing is in contact to attach said tubing to said wall and to direct radiant heat into said structure whereby the object to be painted is heated.

2. The spray chamber according to claim 1 wherein said tubing is formed in a serpentine configuration along substantially the full height of the wall of the structure to increase the surface contact between said tubing and the wall of said structure.

3. The spray chamber according to claim 1 wherein said means for insulating said tubing and walls is polyurethane.

4. A paint chamber for applying radiant heat to an object to prepare the object for painting comprising:

a structure for housing the object to be painted;

tubing fixed in surface contact with the outside of at least one wall of said structure;

said tubing including a feeder line;

an exhaust line;

a plurality of section lines communicating between said feeder line and said exhaust line, said section lines being spaced longitudinally along said structure;

valve means within said section lines for restricting the flow of fluid through each section line whereby the heat emitted from each section line may be regulated;

means for circulating a heated fluid through said tubing to thereby heat the wall of said structure in which said tubing is in contact; and means for insulating the outside of the wall of said structure in which said tubing is in contact to attach said tubing to said wall and to direct radiant heat into said structure whereby the object to be painted is heated.

5. The spray chamber according to claim 4 wherein said section lines are formed in a serpentine arrangement to extend back and forth over at least one wall of said structure thereby increasing the surface contact between said section lines and the wall of said structure.

6. The spray chamber according to claim 5 wherein said feeder line and said exhaust line extend around the perimeter of the structure and said section lines are attached in surface contact with the outer surface of a plurality of the walls of said structure.

7. A paint chamber for applying radiant heat to an object in preparation for painting, comprising:

a spray booth for housing the object to be painted;

tubing including a feeder line and an exhaust line extending along the perimeter of said spray booth;

a plurality of section lines attached between said feeder line and exhaust line and attached along the outer surface and in surface contact with at least one wall of said spray booth;

pump means for circulating a heated fluid through the tubing and section lines to heat the walls of said spray booth;

insulation means for covering the outer surface of the walls of said spray booth and the tubing and section lines to direct radiant heat into the spray booth.

8. The paint chamber according to claim 7 further comprising:

a restrictor valve in each of said section lines permitting the control of the flow of heated fluid through each section line whereby the heat emitted from each section line may be regulated.

9. The paint chamber according to claim 7 wherein said tubing extends around the perimeter of said spray booth and said section lines are formed in a serpentine configuration substantially along the full height of the outer surface and in surface contact with a plurality of walls of said spray booth.

10. The spray chamber of claim 1 further comprising:

a thermostat control means responsive to the temperature within the paint chamber for actuating said circulating means to circulate the heated fluid.

11. A method for providing radiant heat to an object to prepare the object for painting, comprising:

attaching tubes in surface contact with the outer surface of at least one wall of a painting chamber;

covering the tubes and outer wall surfaces of the chamber with an insulating material;

moving the object to be painted into the chamber; and passing heated fluid through the tubes to heat the walls in contact therewith thereby directing radiant heat into the chamber to heat the object for painting.

12. The method of claim 11 wherein covering the tubes and outer wall surfaces of the chamber comprises:

supporting the tubes in surface contact with the wall of the chamber; and applying a layer of polyurethane foam insulation over the tubing and the outer surface of the walls to bond the tubing to the walls of the chamber.

* * * * *